US008256063B2

(12) United States Patent
Bowman

(10) Patent No.: US 8,256,063 B2
(45) Date of Patent: Sep. 4, 2012

(54) STRAP WITH RIGID BARBS

(75) Inventor: Linden H. Bowman, Ellicott City, MD (US)

(73) Assignee: The Lindy Bowman Company, Elkridge, MD (US)

( * ) Notice: Subject to any disclaimer, the term of this patent is extended or adjusted under 35 U.S.C. 154(b) by 230 days.

(21) Appl. No.: 12/760,761

(22) Filed: Apr. 15, 2010

(65) Prior Publication Data

US 2011/0255808 A1 Oct. 20, 2011

(51) Int. Cl.
*A47B 95/02* (2006.01)

(52) U.S. Cl. ..... 16/114.1

(58) Field of Classification Search ..... 16/114.1, 16/428, 444, 442; 24/265 R, 703.1, 703.3, 24/703, 5, 703.6, 713.1, 715.4, 715.7; 383/6, 383/7, 13–17, 21–24; 294/149, 152, 157, 294/74

See application file for complete search history.

(56) References Cited

U.S. PATENT DOCUMENTS

| | | | | |
|---|---|---|---|---|
| 1,349,654 | A | 8/1920 | Bergen | |
| 1,575,022 | A * | 3/1926 | Wakimoto | 24/713.1 |
| 2,753,106 | A | 7/1956 | Baillard et al. | |
| 2,992,768 | A | 7/1961 | Gatward | |
| 3,456,865 | A | 7/1969 | Frank | |
| 3,636,594 | A * | 1/1972 | Faivre | 24/298 |
| 4,691,369 | A | 9/1987 | Costa | |
| 4,967,451 | A | 11/1990 | Boyn | |
| 5,068,945 | A | 12/1991 | Hart et al. | |
| 5,926,924 | A | 7/1999 | Tsai | |
| 6,412,143 | B1 | 7/2002 | Chen | |

FOREIGN PATENT DOCUMENTS

| | | | |
|---|---|---|---|
| EP | 1440897 | A1 * | 7/2004 |
| WO | WO 99/55524 | A1 | 11/1999 |

* cited by examiner

*Primary Examiner* — Chuck Y. Mah
(74) *Attorney, Agent, or Firm* — Cahn & Samuels, LLP

(57) ABSTRACT

An embodiment of the invention includes a device having a first barb proximate a first end of a strap and a second barb proximate a second end of the strap. A first sheath is proximate a portion of the first barb and the first end of the strap, wherein the first sheath has a length less than the length of the first barb. A second sheath is proximate a portion of the second barb and the second end of the strap, wherein the second sheath has a length less than the length of the second barb. The device further includes container having a first aperture and a second aperture. The strap is positioned within the first and second apertures such that the first barb engages the container at the first aperture and the second barb engages the container at the second aperture.

19 Claims, 3 Drawing Sheets

STRAP WITH RIGID BARBS

I. DESCRIPTION OF THE TECHNICAL FIELD

This invention relates to an improvement in strap handles for grasping bags, pouches, sacks and other like containers, and more particularly to a flexible handle having rigid barbs on terminal ends thereof for securing the handle to a bag.

II. BACKGROUND OF THE INVENTION

Bags, pouches, sacks, and the like provide a means for storing and transporting articles of varying shapes and sizes. In addition, decorative bags provide a quick and easy means for wrapping and presenting a gift to a recipient. However, it is often difficult to grasp or hold a bag when the bag is full, the contents of the bag are heavy, and/or when the size of the bag makes holding the bag cumbersome. Regardless of whether a bag is bulky or small, it may also be difficult to hold multiple bags at the same time.

Therefore, handles are often attached to bags to facilitate the ease of grasping, holding, and carrying. Although bags are available in a variety of styles, bags and bag handles are often formed from inexpensive, light-weight materials. A problem commonly associated with bags is the separation of the handle from the bag. For example, when a bag having heavy contents is lifted by the handles, the bag can tear due to inadequate reinforcement at the handle connection points. Furthermore, handles can be pulled away from the bag due to ineffective or poorly designed mechanisms for attaching the handles to the bags.

III. SUMMARY OF THE INVENTION

The invention relates to a bag and flexible strap handle combination having a novel structure.

It is an object of the invention to provide a bag for storing articles therein and for transporting articles.

It is another object of the invention to provide a bag for wrapping and presenting a gift to a recipient.

It is yet another object of the invention to provide a flexible strap for grasping/holding the bag.

It is still another object of the invention to provide barbs for preventing separation of the flexible strap from the bag by engaging the surface of the bag at apertures dimensionally corresponding to the flexible strap.

It is still yet another object of the invention in certain embodiments to provide sheaths for securing the barbs to the strap.

It is a further object of the invention to provide a unique configuration of barbs, sheaths, and straps that present a means for carrying the bag.

Certain of these and other objects are satisfied by a strap handle member having a first barb proximate a first end of the strap handle member and a second barb proximate a second end of the strap handle member. A first sheath is proximate a portion of the first barb and the first end of the strap, wherein the first sheath has a length less than the length of the first barb. A second sheath is proximate a portion of the second barb and the second end of the strap, wherein the second sheath has a length less than the length of the second barb.

The first and second sheaths attach the first and second barbs, respectively, to the strap. More specifically, the first sheath covers only one terminal end of the first barb; and, the second sheath covers only one terminal end of the second barb. The portion of the first barb covered by the first sheath is less than the total size of the first barb; and, the portion of the second barb covered by the second sheath is less than the total size of the second barb. The first barb includes a first barb member extending from the first sheath at a distance greater or equal to the length of the first sheath; and, the second barb includes a second barb member extending from the second sheath at a distance greater or equal to the length of the second sheath.

In at least one embodiment, the first and second barbs are formed from a first material; and, the strap is formed from a second material different from the first material. The first and second barbs and/or the first and second sheaths each have a rigidity greater than a rigidity of the strap. In another embodiment, the first and second sheaths and the first and second barbs are integrally formed from a common plastic material as the strap.

The container includes at least a first aperture and a second aperture, wherein the strap is positioned within the first and second apertures such that the first barb engages the container at the first aperture and the second barb engages the container at the second aperture. When the strap is pulled, the first and second barbs engage a surface of the container. The first barb has a width less than or equal to the diameter of the first aperture; and, the second barb has a width less than or equal to the diameter of the second aperture. Moreover, the first barb has a length greater than the diameter of the first aperture; and, the second barb has a length greater than the diameter of the second aperture. Thus, the first barb prevents the first end of the strap from being pulled out of the container through the first aperture; and, the second barb prevents the second end of the strap from being pulled out of the container through the second aperture.

For definitional purposes and as applicable, the term "container" as used herein is intended to mean a vessel for storing contents therein, and may be in the form of a bag, pouch, sack, satchel, purse, and the like.

As used herein, the term "strap" is intended to mean a flexible elongated member having a length substantially greater than its cross-sectional dimension, and may be in the form of a leash, ribbon, lace, handle, and the like.

As used herein, "sheath" is intended to mean a bonded segment having a length corresponding to substantially less than the associated barb, and may be in the form of an aglet, tube, cover, covering, wrap, wrapping, wrapper, and the like.

As used herein, the term "barb" is intended to mean an elongated rod-like structure offset from the axis of the associated strap, and may be in the form of a dowel, shaft, bar, stopper, and the like.

As used herein, "aperture" is intended to mean a feed-through dimensioned to retain the associated strap therein, and may be in the form of an eye, eyelet, hole, opening, orifice, pass-through, passage, perforation, slit, slot, and the like.

In the following description, reference is made to the accompanying drawing which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

IV. BRIEF DESCRIPTION OF THE DRAWING

V. DETAILED DESCRIPTION OF THE EMBODIMENTS

Referring now to the figures, wherein like reference numbers denote like components, elements, or features through the various illustrated embodiments discussed in detail below, the invention is a device including a container and a strap. While specific implementations of the disclosed technology are discussed, it should be understood that this is done for illustration purposes only. A person skilled in the relevant art will recognize that other components and configurations may be used without departing from the spirit and scope of the invention.

Figure 1:
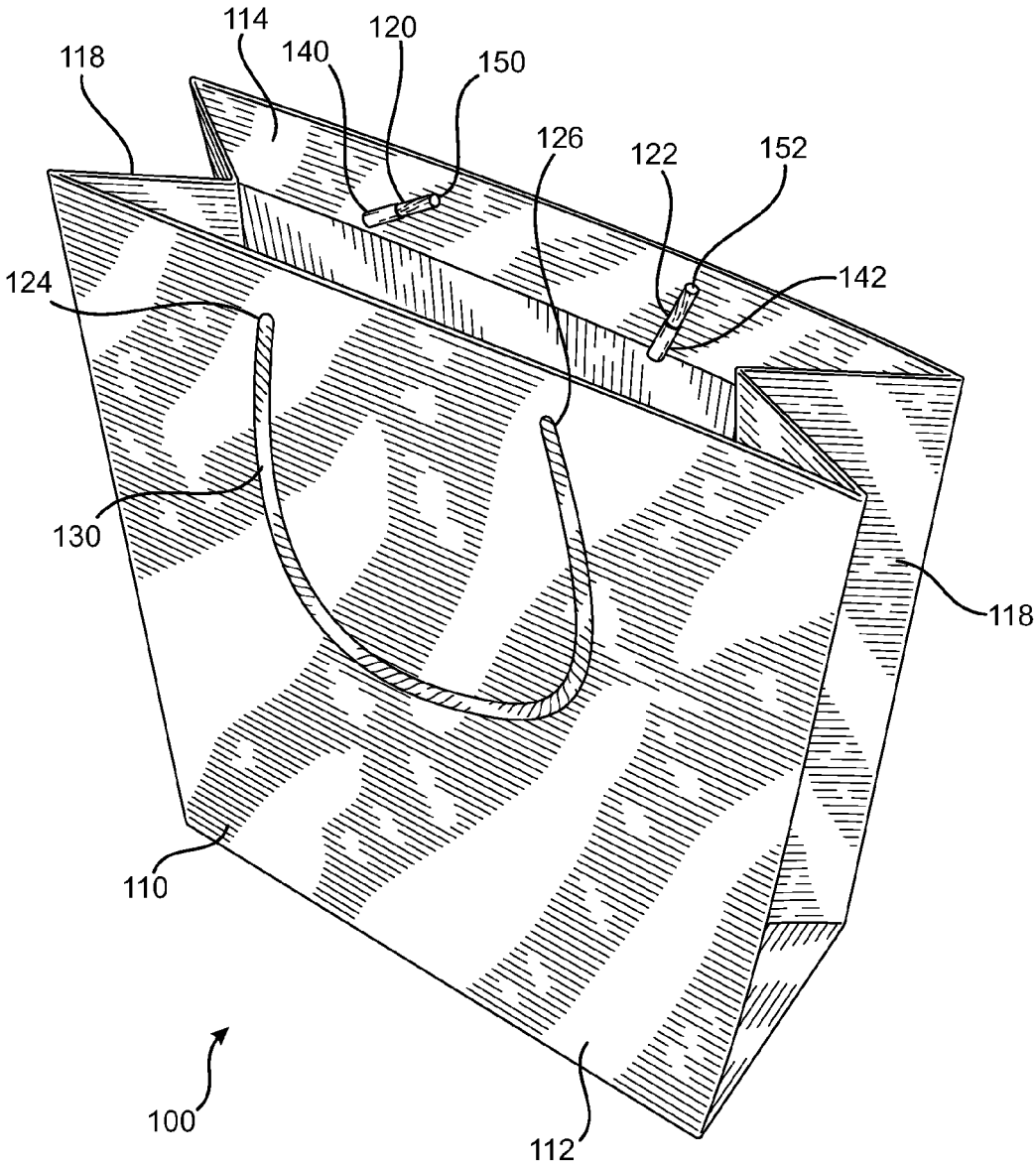
FIG. 1 is a front perspective view of a combination container and strap device according to an embodiment of the invention.

FIG. 1 illustrates a device 100 according to an embodiment of the invention. The device 100 includes a container 110 for retaining articles therein, wherein the container 110 includes a bottom 111 (not shown) connected to a first panel 112, a second panel 114, a third panel 116, and a fourth panel 118. The bottom 111, first panel 112, second panel 114, third panel 116, and fourth panel 118 are rectangular-shaped, wherein the first panel 112 and second panel 114 are equal in size, and wherein the third panel member 116 and fourth panel member 118 are equal in size. In another embodiment, the bottom 111, first panel 112, second panel 114, third panel 116, and fourth panel 118 have different sizes and shapes, for example, circles, ovals, squares, and/or triangles of varying sizes. In another embodiment, the container 110 lacks the bottom 111, third panel 116 and fourth panel 118, wherein the container 110 resembles a pouch, satchel, sack, purse, or the like.

The container 110 is integrally formed from a single sheet of material. In another embodiment, however, the container 110 includes two or more separate sheets of material that are bonded via adhesive. The container 110 is formed from semi-rigid organic material, such as, for example, paper, cardboard, and/or plastic. In an another embodiment, the container 110 is formed from other materials of varying stiffness/flexibility, for example, wood, metal, ceramic, and/or glass.

Figure 2:
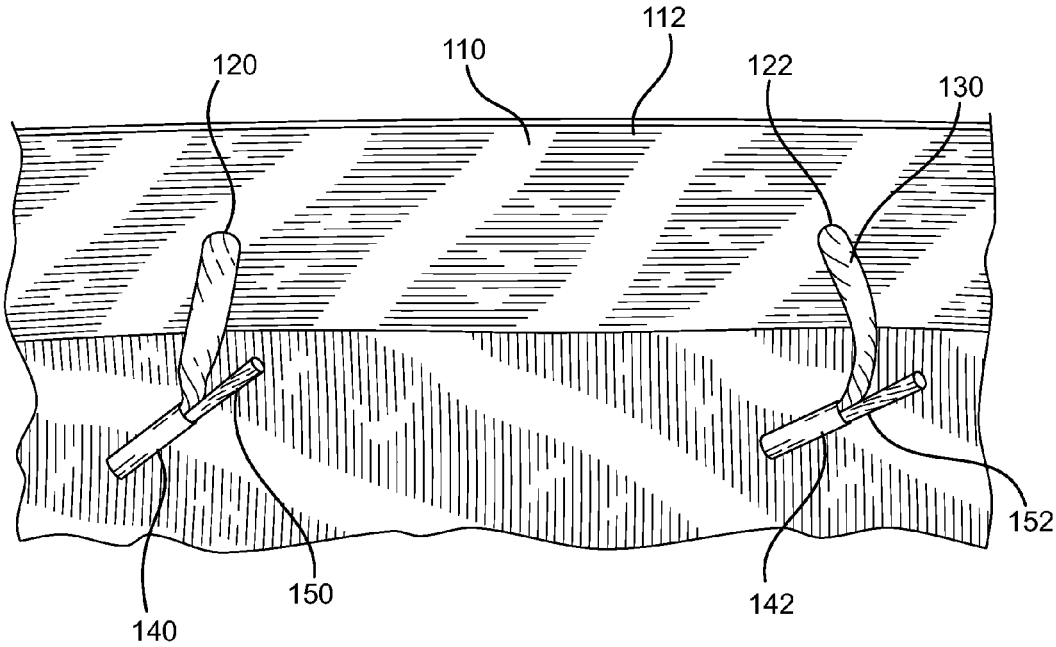
FIG. 2 is a top perspective view of an upper inner wall of the container illustrated in FIG. 1.

As illustrated in FIG. 2, the first panel 112 and second panel 114 include circular apertures 120 and 122, and 124 and 126, respectively, on upper portions thereof. In another embodiment, the apertures 120, 122, 124, and 126 have other shapes, such as, for example, ovals, squares, rectangles, and/or triangles. In yet another embodiment, the first panel 112 and second panel 114 includes grommets and/or reinforcement wall(s) to strengthen the structural integrity of the apertures 120, 122, 124, and 126.

The device 100 includes a pair of flexible, elongated, lace-style straps 130 formed from braided cotton fiber. In another embodiment, the straps 130 are formed from other materials of varying flexibility, such as, for example, plastic, rubber, nylon, and/or other types of fabric. A first sheath 140 and a second sheath 142 are disposed on opposite terminal ends of each strap 130. As described more fully below, the sheaths 140 and 142 attach barbs to the strap 130. The sheaths 140 and 142 are each formed from rigid plastic in the shape of a tube. In another embodiment, the sheaths 140 and 142 are formed from other materials of varying flexibility/stiffness, such as, for example, rubber, metal, wood, or an organic-based fiber. In another embodiment, the sheaths 140 and 142 have other shapes, such as, for example, coils or individual rings/clamps for attaching the barbs to the strap 130.

A first barb 150 and a second barb 152 are disposed on opposite terminal ends of each strap 130. The barbs 150 and 152 are each formed from rigid cardboard in the shape of a cylinder. In another embodiment, the barbs 150 and 152 are formed from other materials of varying flexibility/stiffness, such as, for example, plastic, metal, or wood. In yet another embodiment, the barbs 150 and 152 have other shapes, such as, for example, discs, blocks, or bars. The barbs 150 and 152 each have a width less than or equal to the diameters of the apertures 120, 122, 124, and 126. Moreover, the barbs 150 and 152 each have a length greater than the diameters of the apertures 120, 122, 124, and 126. As used herein, the term "diameter" of the aperture is meant to include the horizontal dimension, vertical dimension, and diagonal dimension of the aperture. As used herein, the term "width" of the barb is meant to include the horizontal dimension, vertical dimension, and diagonal dimension of the cross-section of the barb.

Figure 3:
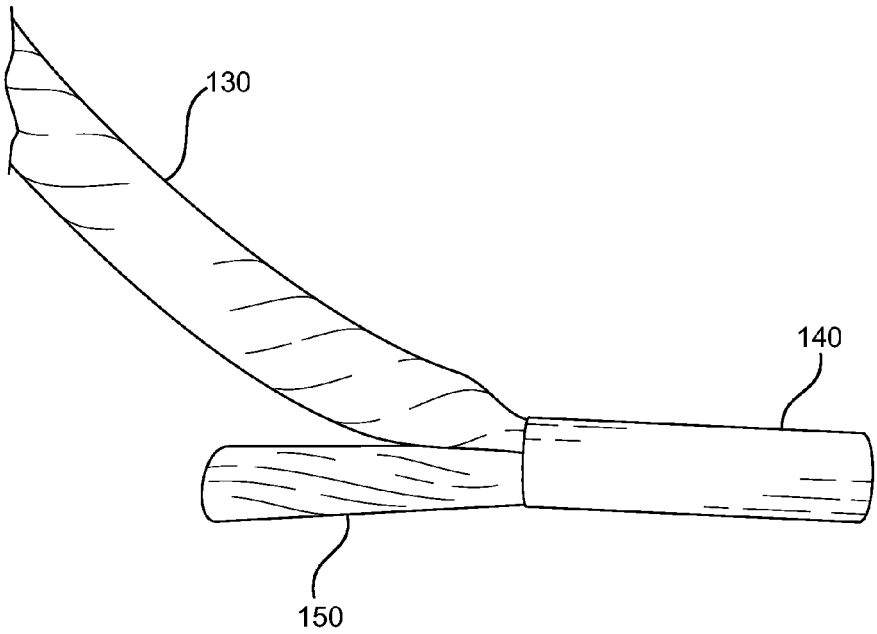
FIG. 3 is a close-up view of the strap illustrated in FIG. 1.

The barbs 150 and 152 are positioned within the sheaths 140 and 142, respectively. More specifically, the sheaths 140 and 142 cover portions of the barbs 150 and 152 and the opposite terminal ends of the strap 130. For instance, as illustrated in FIG. 3, the first sheath 140 covers terminal ends of the first barb 150 and the strap 130. In another embodiment, the sheaths 140 and 142 only cover the terminal ends of the barbs 150 and 152, wherein the terminal ends of the strap 130 protrude out from the sheaths 140 and 142. In yet another embodiment, the sheaths 140 and 142 only cover the terminal ends of the strap 130, wherein both terminal ends of the barbs 150 and 152 protrude out from the sheaths 140 and 142 to form T-shape configurations. In still another embodiment, the strap 130, sheaths 140 and 142, and barbs 150 and 152 are integrally formed, such that a handle is formed from a single piece of material.

The straps 130 pass through the apertures 120, 122, 124, and 126, wherein the sheaths 140, 142 and barbs 150, 152 are positioned either inside or outside of the container 110. If the sheaths 140, 142 and barbs 150, 152 are inserted into the apertures 120, 122, 124, and 126 from the outside of the container, the sheaths 140, 142 and barbs 150, 152 are pulled flush against the inner surfaces of the first panel 112 and second panel 114 when the straps 130 are pulled. Thus, the barbs 150 and 152 prevent the sheaths 140 and 142 from being dislodged from the apertures 120, 122, 124, and 126, thereby securing the straps 130 to the container 110.

Figure 4:
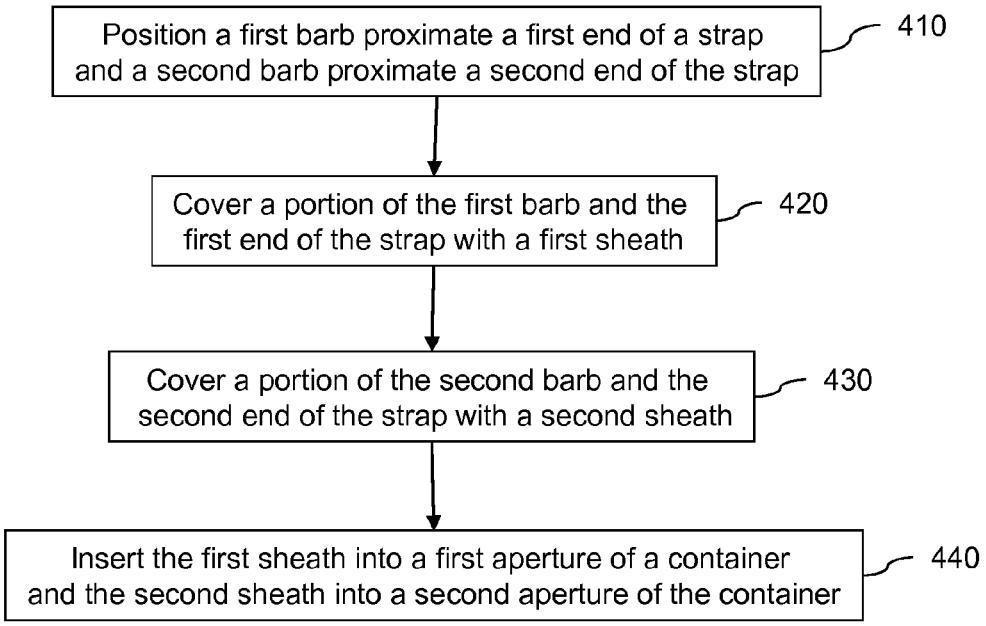
FIG. 4 is a flow diagram illustrating a method for forming a combination container and strap device according to an embodiment of the invention.

FIG. 4 is a flow diagram illustrating a method of manufacturing a device according to an embodiment of the invention. A first barb is positioned proximate a first end of a strap and a second barb is positioned proximate a second end of the strap (410). A first sheath is positioned proximate a portion of the first barb and the first end of the strap, wherein the first sheath has a length less than the length of the first barb (420). In at least one embodiment, the first barb is attached to the strap by wrapping the first sheath around the portion of the first barb and the first end of the strap. Only one terminal end of the first barb and at least half the length of the first barb are covered by the first sheath.

A second sheath is positioned proximate a portion of the second barb and the second end of the strap, wherein the second sheath has a length less than the length of the second barb (430). In at least one embodiment, the second barb is attached to the strap by wrapping the second sheath around the portion of the second barb and the second end of the strap.

Only one terminal end of the second barb and at least half the length of the second barb are covered by the second sheath.

The first sheath is inserted into a first aperture of a container and the second sheath is inserted into a second aperture of the container (440). The first sheath is threaded through the first aperture such that the first barb passes through the first aperture. Similarly, the second sheath is threaded through the second aperture such that the second barb passes through the second aperture.

Figure 5:
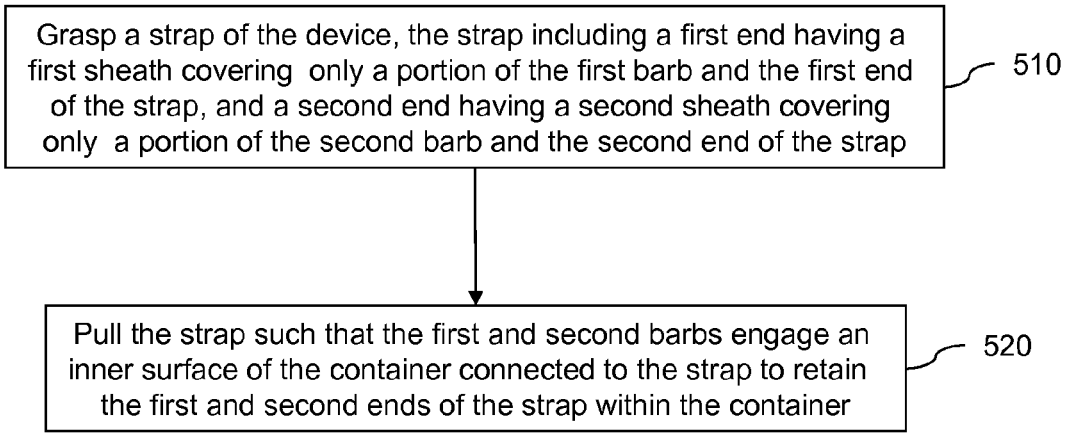
FIG. 5 is a flow diagram illustrating a method for using a combination container and strap device according to an embodiment of the invention.

FIG. 5 is a flow diagram illustrating a method of using a device according to an embodiment of the invention. A strap of the device is grasped (510), wherein the strap includes a first end having a first sheath proximate (e.g., covering) only a portion of a first barb and the first end of the strap. The strap further includes a second end having a second sheath proximate (e.g., covering) only a portion of a second barb and the second end of the strap. As described above, the first and second sheaths attach the first and second barbs, respectively, to the strap. In at least one embodiment of the invention, the first sheath covers only one terminal end of the first barb; and, the second sheath covers only one terminal end of the second barb.

The strap is pulled such that the first and second barbs engage a surface of a container connected to the strap to prevent dislodgement of the strap from the container (520). Thus, the first barb prevents the first end of the strap from being pulled away from the container through a first aperture; and, the second barb prevents the second end of the strap from being pulled away from the container through a second aperture.

Although specific example embodiments have been illustrated and described herein, those of ordinary skill in the art appreciate that other variations, aspects, or embodiments may be contemplated, and/or practiced without departing from the scope or the spirit of the appended claims.

The invention claimed is:

1. A device comprising:

a strap comprising a first end and a second end;

a first barb proximate said first end of said strap;

a first sheath proximate a portion of said first barb and said first end of said strap, said first sheath having a length less than a length of said first barb, wherein said first sheath covers only one terminal end of said first barb;

a second barb proximate said second end of said strap; and a second sheath proximate a portion of said second barb and said second end of said strap, said second sheath having a length less than a length of said second barb, wherein said second sheath covers only one terminal end of said second barb.

2. The device according to claim 1, wherein said first barb comprises a first barb member extending from said first sheath at a distance one of greater to and equal to the length of said first sheath, and wherein said second barb comprises a second barb member extending from said second sheath at a distance one of greater to and equal to the length of said second sheath.

3. The device according to claim 1, wherein said first sheath attaches said first barb to said strap, and wherein said second sheath attaches said second barb to said strap.

4. The device according to claim 1, wherein said first sheath and said first barb are integral with said strap, and wherein said second sheath and said second barb are integral with said strap.

5. The device according to claim 1, wherein said first and second barbs are formed from a first material, and wherein said strap is formed from a second material different from said first material.

6. The device according to claim 1, wherein said first and second barbs each have a rigidity greater than a rigidity of said strap.

7. The device according to claim 1, wherein said first and second sheaths each have a rigidity greater than a rigidity of said strap.

8. The device according to claim 1, further comprising a container comprising a first aperture and a second aperture, wherein said strap is positioned within said first and second apertures such that said first barb engages said container at said first aperture and said second barb engages said container at said second aperture.

9. The device according to claim 8, wherein said first and second barbs engage an inner surface of said container when said strap is pulled.

10. The device according to claim 8, wherein said first barb comprises a length greater than a diameter of said first aperture, and wherein said second barb comprises a length greater than a diameter of said second aperture.

11. The device according to claim 8, wherein said first barb comprises a width one of less than and equal to a diameter of said first aperture, and wherein said second barb comprises a width one of less than and equal to a diameter of said second aperture.

12. A method of forming a device, said method comprising:

positioning a first barb proximate a first end of a strap and a second barb proximate a second end of the strap;

positioning a first sheath proximate a portion of the first barb and the first end of the strap, the first sheath having a length less than a length of the first barb, wherein said positioning of the first sheath comprises covering only one terminal end of the first barb; and positioning a second sheath proximate a portion of the second barb and the second end of the strap, the second sheath having a length less than a length of the second barb, wherein said positioning of the second sheath comprises covering only one terminal end of the second barb.

13. The method according to claim 12, wherein said positioning of the first sheath comprises covering at least half the length of the first barb with the first sheath, and wherein said positioning of the second sheath comprises covering at least half the length of the second barb with the second sheath.

14. The method according to claim 12, wherein said positioning of the first sheath comprises wrapping the first sheath around the portion of the first barb and the first end of the strap, and wherein said positioning of the second sheath comprises wrapping the second sheath around the portion of the second barb and the second end of the strap.

15. The method according to claim 12, wherein said positioning of the first sheath comprises attaching the first barb to the strap, and wherein said positioning of the second sheath comprises attaching the second barb to the strap.

16. The method according to claim 12, further comprising inserting the first sheath into a first aperture of a container and the second sheath into a second aperture of the container.

17. The method according to claim 16, wherein said inserting of the first sheath comprises threading the first sheath through the first aperture such that the first barb passes through the first aperture, and wherein said inserting of the second sheath comprises threading the second sheath through the second aperture such that the second barb passes through the second aperture.

18. A device comprising:

a strap comprising a first end and a second end;

a first barb proximate said first end of said strap, said first barb being formed from a first material;

a first sheath proximate a portion of said first barb and said first end of said strap, said first sheath having a length less than a length of said first barb, said first sheath being formed from a second material different from said first material;

a second barb proximate said second end of said strap, said second barb being formed from said first material; and a second sheath proximate a portion of said second barb and said second end of said strap, said second sheath having a length less than a length of said second barb, said second sheath being formed from said second material.

19. The device according to claim 18, wherein said first sheath covers only one terminal end of said first barb, and wherein said second sheath covers only one terminal end of said second barb.

* * * * *